United States Patent [19]

Gale

[11] 4,297,669

[45] Oct. 27, 1981

[54] THERMAL CUT-OUTS AND TO THE METHOD OF ASSEMBLING A MULTIPLICITY OF SUCH THERMAL CUT-OUTS

[75] Inventor: James A. Gale, Warminster, England

[73] Assignee: Kenneth E. Beswick Ltd., Somerset, England

[21] Appl. No.: 70,028

[22] Filed: Aug. 27, 1979

[30] Foreign Application Priority Data

Mar. 8, 1978 [GB] United Kingdom ..... 34926/78

[51] Int. Cl.[3] ..... H01H 37/76; H01H 69/00

[52] U.S. Cl. ..... 337/407; 29/622; 337/413; 337/414

[58] Field of Search ..... 337/401, 403–405, 337/407, 413, 414–416; 29/622, 623; 339/247, 270 F, 98, 99 R

[56] References Cited

U.S. PATENT DOCUMENTS

| | | | |
|---|---|---|---|
| 3,397,380 | 8/1968 | Puig | 339/99 R |
| 3,573,713 | 4/1971 | Enright | 339/98 |
| 4,135,177 | 1/1979 | Kelley et al. | 337/407 |
| 4,255,736 | 3/1981 | Kelley et al. | 337/407 |

FOREIGN PATENT DOCUMENTS

| | | | |
|---|---|---|---|
| 2200843 | 7/1973 | Fed. Rep. of Germany | 337/403 |
| 1118095 | 5/1956 | France | 337/404 |

*Primary Examiner*—William H. Beha, Jr.
*Attorney, Agent, or Firm*—Bacon & Thomas

[57] ABSTRACT

A thermal cut-out which is adapted to open an electrical circuit in response to an excessive rise in temperature associated with the circuit protected by said cut-out. Said cut-out comprising a hollow body of electrically insulating material and having an opening through which a pair of contact members are put into said hollow body. A plug of electrically insulating material closing said opening and stressing the contacts to a condition in which they are biased apart. Said contact members being retained in engagement by an element as long as its temperature has not reached a predetermined temperature. Said element being made from a material which deforms or collapse at said predetermined temperature so that it cannot retain said biased contacts any longer in engagement and permits the contacts to open.

6 Claims, 3 Drawing Figures

Figure 1:
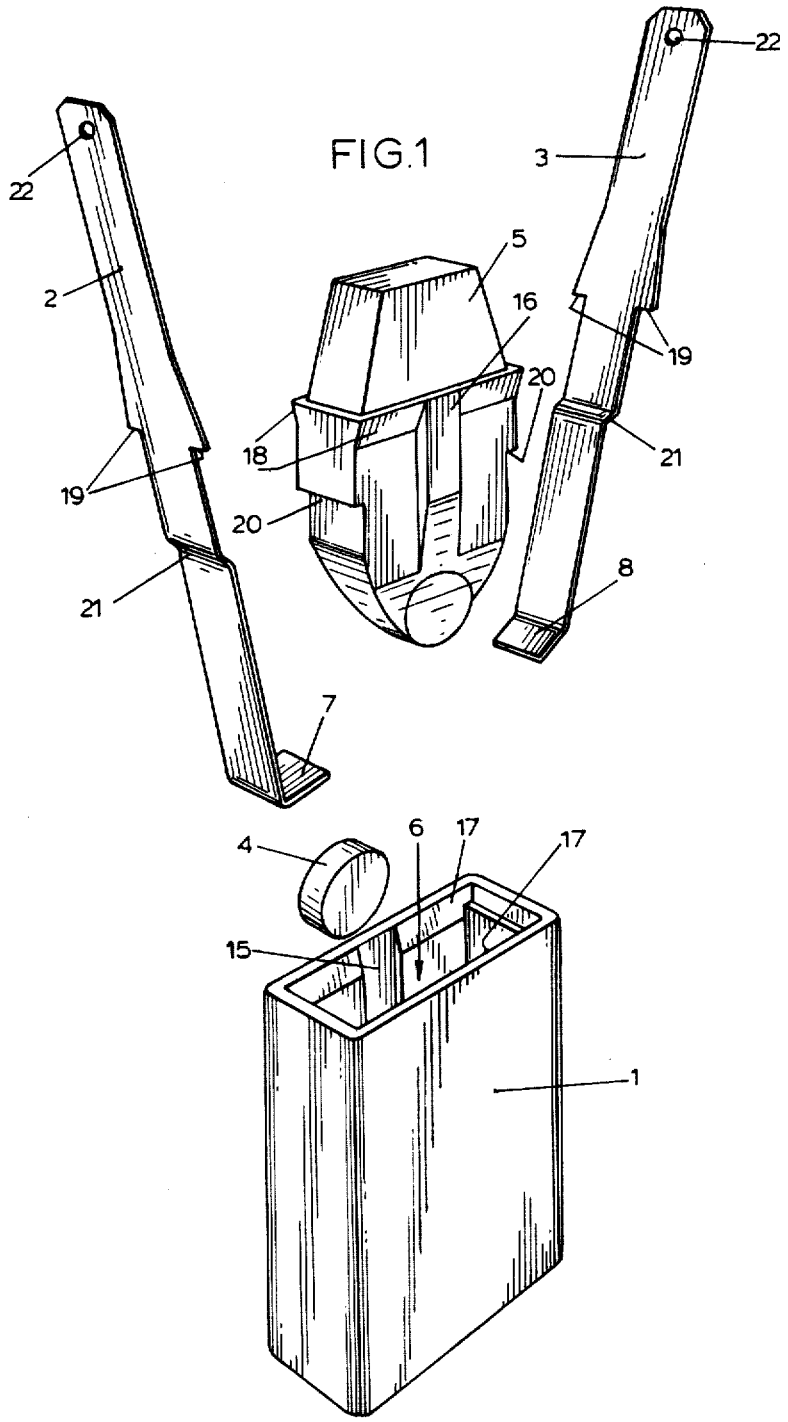

22
2
19
21
7
22
3
19
21
8
5
16
20
18
20
4
6
17
17
15
1

THERMAL CUT-OUTS AND TO THE METHOD OF ASSEMBLING A MULTIPLICITY OF SUCH THERMAL CUT-OUTS

The present invention relates to a thermal cut-out which is adapted to open an electrical circuit in response to an excessive rise in temperature assocated with the circuit protected by said cut-out.

Thermal cut-outs of this type are known in which two contacts are biassed to a normally open position and are held in a closed position by an element which is made of a thermoplastic material such that, at a predetermined temperature, it deforms or collapses to allow the contacts to assume their nornally open position. Said cut-outs have an insulating housing made in two parts, a first one of which is provided with a raised area, shaped similarly to a flat-iron, around which the two spring contacts are fitted and stressed with a bent end of one contact hooked over the end of the other. The contacts are held together by a hollow cylindrical thermo-plastic element which is retained in position by resting in a shaped corner of another raised portion of the first housing part. The second part of the housing is secured in position over the first part, in order to encase the contacts and the thermoplastic element, by means of a rivet fixed through the two housing parts.

The assembly of said prior cut-outs present certain problems. Hence, it is a problem to assembly the spring contacts on the first housing part in the stressed condition and with their ends interengaged, to position the thermoplastic element so as to retain the contact ends engaged, and to hold all these components in position whilst the second housing part is assembled over and fixed to the first housing part to retain the components in their assembled positions. Moreover, when the housing parts have been assembled together a separate rivetting operation is required in order to fix them together.

One object of the present invention is to provide a construction of thermal cut-out of the type described above, which facilitates manufacture and assembly of the cut-out, which avoids the need for a rivetting operation, and which lends itself more readily to manufacture by mass production techniques. It is also an object of the invention to provide a simpler method of manufacturing and assembling such a cut-out.

The invention consists in a thermal cut-out comprising a hollow body made from electrically insulating material and having an opening permitting access to the interior of the body, a pair of contact members projecting into the body through said opening and having their inner ends disposed within the body, retained in engagement by a thermoplastic or fusible element, which element is softenable or fusible at a predetermined temperature so as to deform or collapse and permit the contacts to open, and a plug of insulating material disposed within the opening in the body between said contacts so as to close said opening and stress the contacts to a condition in which they are biassed apart.

Preferably, the inner ends of the contacts are interengaged via a bent or hooked end portion of one of the contacts hooked-over an adjacent end portion of the other contact. These end portions may be disposed in surface-to-surface engagement.

The insulating plug may be provided with a snap fit in the opening in the body. For example, the plug and body may be formed with one or more cooperating protuberances and dimples which are a snap-fit together when the plug is fully inserted into the body so as to lock the plug in position.

The body may be made of insulating material which may be transparent so that the state of the contacts is visible.

The inside end of the body may incline towards a recess so that the element automatically seats itself in its correct position.

The contacts may be formed with shoulders which engage the end of the body to define the fully inserted positions of the contacts. The plug may be formed at opposite edges with rebates and the contacts being provided inwardly deformed parts with which the rebates engage.

The deformable or collapsable element may consist of a thermoplastic or other insulating material which has a low melting range.

The invention also consists in a method of assembling a thermal cut-out, comprising the steps of utilising a hollow body made from electrically insulating material and having an opening permitting access to the interior of the body, disposing a thermoplastic or fusible element in a predetermined position within the body, arranging a pair of contact members to project into the body through the opening, the inner ends of said contacts disposed within the body being interengaged and one of said members abutting said thermoplastic or fusible element so that the latter retains the inner ends interengaged, and inserting a plug of insulating material into the opening in the body between the contact members so as to close said opening and stress the contact members, thereby biassing them apart.

This invention enables a multiplicity of thermal cut-outs to be assembled in a single assembly sequence. This may be achieved by arranging a multiplicity of insulating bodies at a predetermined spacing a thermoplastic or fusible element being disposed in each of said bodies a same multiplicity of contacts and plugs being arranged at the same predetermined spacing, said multiplicity of contacts being simultaneously inserted through the openings in the bodies into the bodies where after said multiplicity of plugs are pressed into said bodies.

The bodies contacts and plugs may be moulded in strips and at a spacing corresponding for each contact pair. Having disposed a thermoplastic or fusible element in each body of a strip of insulating bodies, strips of contacts, are inserted into the bodies with their inner ends interengaged and with the end of one of the contacts in each body abutting the associated element. Thereafter, the plugs in a strip are simultaneously inserted into the openings in the bodies so as to complete the cut-outs. Finally metal strips and plastic runners which join the contacts, bodies and plugs may be broken off or cut so as to separate the batch into individual cut-outs. If desired, whilst the cut-outs are still connected by means of the plastic runners, but after the metal strips joining the contacts had been removed, the batch may be bulk tested.

Figure 2:
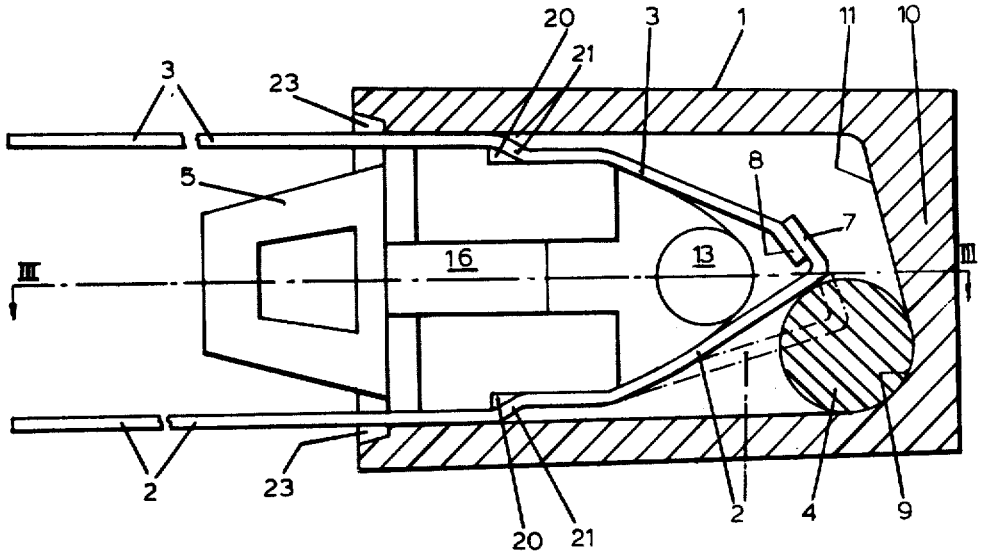
Figure 3:
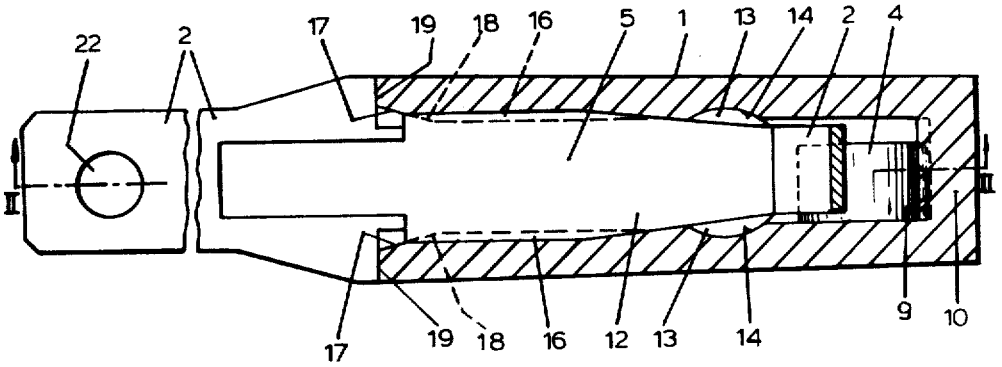

In order that the invention may be more readily understood, reference will now be made to the accompanying drawings in which:

FIG. 1 is an exploded perspective view of a miniature thermal cut-out constructed in accordance with the invention, FIG. 2 is a sectional view of the assembled cut-out taken on the line II—II of FIG. 3, FIG. 3 is a section on the line III—III of FIG. 2.

Referring to the drawings, the thermal cut-out comprises a hollow body 1 made from insulating material, a pair of spring contact members 2,3, a thermoplastic element 4 in the form of a cylindrical pellet, and a plug 5 also made from insulating material. The body may be moulded from transparent plastics material. It is of rectangular shape in plan and has an opening 6 at one end permitting access to the interior of the body. The contacts 2,3 are stamped from thin metal strips and project into the body through the opening and have their inner ends, disposed within the body, interengaged. The inner end portion 7 of the contacts 2 is bent approximately at right angles to the adjacent part of the contact and hooks over the adjacent bent end portion 8 of the contact 3 so that there is surface-to-surface engagement between the ends of the contacts. The inner ends of the contacts are retained in engagement by the pellet 4 which sits in an appropriately shaped recess 9 in the inside of the closed end 10 of the body. The inside end 11 of the housing is inclined towards the recess so that the pellet automatically seats itself in its correct position when it is dropped into the body through the opening 6.

The contacts 2,3 are secured in position and are stressed so as to be resiliently biassed apart by the plug 5 which is disposed in the opening 6 between the contacts and closes this opening. This plug may be moulded from plastics material and, in plan, is somewhat similar in shape to a flat-iron. The nose 12 of the plug projects into the body and is moulded at opposite sides with two small proturberances or bulges 13 which are a snap-fit into coperating dimples 14 on the inside surface of the body so as to lock the plug in position. The inside surface of the body is moulded with lead-in grooves 15 which guide the proturberances into the dimples when the plug is inserted. These grooves are closed by ribs 16 moulded on the plug. The body and plug have cooperating bevelled surfaces 17,18 which engage, when the plug is snapped into position, so that the opening 6 in the body is effectively sealed.

The contacts 2,3 are formed with shoulders 19 which engage the end of the body to define the fully inserted positions of the contacts. To prevent the contacts from being pulled outwardly from the body, the plug 5 is formed at opposite edges with rebates 20 which engage with inwardly deformed parts 21 of the contacts. The outer ends of the contacts are formed with apertures 22 and serve as terminals for connecting the cut out in an electrical circuit.

Whilst the opening 6 in the body is satisfactorily sealed by the plug 5, contacts 2,3 and bevelled surfaces 17,18 if additional sealing is required, a low viscosity sealant may be applied to the groove 23 extending about the opening and formed between the plug and the body for this purpose.

The pellet 4 is made from thermoplastic material, for example, polysterene, having a narrow melting range. In use, the mechanical properties of the thermoplastic material of the pellet remain virtually unchanged with increasing temperatures up to the lower end of its melting range, whereupon, for a further small increase in temperature, its mechanical properties deteriorate such that the pellet becomes soft and collapses under the action of the spring contact 2 which moves into the position shown in broken lines in FIG. 2. When the predetermined operating temperature is reached, the contacts 2,3 can therefore spring apart to open the electrical circuit in which the cut-out is connected. When the contacts spring apart, a considerable gap exists therebetween to ensure minimum arcing. The operating temperature of the cut-out can be varied by making the pellet of other materials. Once it has operated the cut-out cannot be reset and it is therefore suitable for apparatus which has to meet international safety requirements. It has a low thermal capacity and therefore a correspondingly high sensitivity to heat.

The cut-out described above is assembled with the body in a vertical position. The pellet 4 is first dropped into the body and, by reason of the inclined inside end 11 of the body, automatically seats itself in the correct position in its recess 9. Thereafter, two spring contact members 2,3 are inserted into the body in a "V" configuration with the outer surface of portion 8 of the contact 3 resting against the inner surface of the bent end portion 7 of the contact 2. The outer surface of the inner end 7 of the contact 2 is disposed abutting the pellet. The shoulders 19 on the two contacts limit the extent to which the inner ends of the contacts can be inserted into the body. The plug 5 is now inserted into the opening 6 in the body between the contacts 2,3 and, as the nose 12 of the plug is pressed into the body between the contacts, it deforms the contacts outwardly so as to stress them into a condition in which they are resiliently biassed apart disengagement of the contacts being prevented by the pellet 4. When the plug is fully inserted, the protuberances 13 snap into the dimples 14 on the inside surface of the body to lock the plug in position and prevent the cut-out from coming apart during service.

The construction of the thermal cut-out and its method of assembly is particularly adapted to enable a multiplicity of the cut-outs to be assembled in a single assembly sequence. In one example of a multiple assembly sequence, the bodies 1 of the cut-outs are moulded in strips of five or ten connected together at a predetermined spacing by runners of the plastics material. The plugs 5 are similarly moulded in strips. The contacts 2,3 are stamped-out, heat-treated and plated in strips of ten contacts, which are attached to a "rail" so that each strip may be picked up as a batch of ten contacts at a spacing corresponding to that of the bodies and plugs.

For assembling the cut-outs, a strip of ten (or two strips of five) bodies are disposed in an assembly jig with the body openings 6 uppermost. Ten thermoplastic pellets 4 are then dropped into the bodies, respectively, and automatically seat in the required position, as described above. Thereafter, a strip of ten contacts 2 is supported in the jig their inner ends projecting into the bodies and the operation is repeated with a strip of contacts 3. At this stage in the assembly, the contacts 2 are resting with their inner ends of upon the pellets 4 and each pair of contacts 2,3 is disposed in a "V" configuration with the outer surface of end 8 of the contact 3 resting against the inner surface of end 7 of the contact 2. The contacts are not under stress. A strip of ten (or two strips of five) plugs is next located in the jig and, by use of this jig, they are pressed into the bodies until the cooperating protuberances and dimples snap together and lock the plugs in position. This step deforms and stresses the contacts 2,3 so that the end 7 of each contact 2 presses againt the associated pellet 4 which prevents the two contacts from springing apart. The batch of assembled cut-outs may now be removed in one piece from the jig and the metal rails joining the contacts may be broken-off. Since the cut-outs are then still connected by means of the plastic rubbers between the plugs and bodies, it is possible to test a batch in one operation before separating the plastic runners.

Whilst particular embodiments have been described, it will be understood that modifications can be made without departing from the scope of this invention.

I claim:

1. A thermal cut-out which is adapted to open an electrical circuit in response to an excessive rise in temperature associated with the circuit protected by said cut-out, said cut-out comprising a hollow body made from electrically insulating material and having an opening permitting access to the interior of the body, a pair of contact members projecting into the body through said opening and having their inner ends disposed within the body, one of said contact members being bent and hooked over an adjacent bent end portion of the other contact and in surface-to-surface contact therewith, a plug of insulating material being disposed within the opening in the body between said contacts, so as to close said opening and stress the contacts to a condition in which they are biased apart, surfaces of said contact members being retained in engagement by an element bearing with surface contact againt one side of one of the contacts as long as its temperature has not risen to a predetermined temperature, said element being made of such a material that having reached said predetermined temperature it deforms and permits the contacts to open.

2. A thermal cut-out according to claim 1, characterized in that the inner ends of the contacts are interengaged via a bent or hooked end portion of one of the contacts hooked-over and adjacent end portion of the other contact said end portions being disposed in surface-to-surface engagement.

3. A thermal cut-out which is adapted to open an electrical circuit in response to an excessive rise in temperature associated with the circuit protected by said cut-out, said cut-out comprising a hollow body made from electrically insulating material and having an opening permitting access to the interior of the body, a pair of contact members projecting into the body through said opening and having their inner ends disposed within the body, one of said contact members being bent and hooked over an adjacent bent end portion of the other contact and in surface-to-surface contact therewith, a plug of insulating material having projections cooperating with recesses in said body to provide a snap fit in its fully inserted position in said hollow body, sad plug being disposed within the opening in the body between said contacts, so as to close said opening and stress the contacts to a condition in which they are biased apart, said contact members being retained in engagement by an element as long as its temperature has not risen to a predetermined temperature, said element being made of such a material that having reached said predetermined temperature it deforms and permits the contacts to open.

4. A thermal cut-out according to claim 1, characterized in that the inside end of the hollow body being inclined towards a recess in said inside end so that the element automatically seats itself in its correct position.

5. A thermal cut-out according to claim 1, characterized in that the element consists of a thermoplastic or other material having a narrow melting range.

6. A method of assembling at least one thermal cut-out comprising the steps of utilizing a hollow body made from electrically insulating material and having an opening permitting access to the interior of the body, disposing a thermoplastic of fusible element in a predetermined position within the body, placing a first contact member in said body, through said opening, said first contact member having its inner end bent to define a hook-like end; placing a second contact member in said body with its inner end in said hook-like end and in surface-to-surface contact therewith, one of said members abutting said thermoplastic or fusible element so that the latter retains the inner ends interengaged, and inserting a plug of insulating material into the opening in the body between the contact members so as to close said opening and stress the contact members, thereby biasing them apart.

* * * * *